US010451056B2

(12) United States Patent
Blechschmidt

(10) Patent No.: US 10,451,056 B2
(45) Date of Patent: Oct. 22, 2019

(54) GEROTOR PUMP HAVING AN INNER GEAR, A ROTOR, AND AN OUTER GEAR, WITH INCLINED LUBRICATION SURFACE ON TEETH OF FACE WALL OF ROTOR ADJACENT TO PRESSURE KIDNEY AND SUCTION KIDNEY

(71) Applicant: NIDEC GPM GmbH, Auengrund ot Merbelsrod (DE)

(72) Inventor: Andreas Blechschmidt, Zella-Mehlis (DE)

(73) Assignee: NIDEC GPM GmbH, Auengrund ot Merbelsrod (DE)

( * ) Notice: Subject to any disclaimer, the term of this patent is extended or adjusted under 35 U.S.C. 154(b) by 75 days.

(21) Appl. No.: 15/534,077

(22) PCT Filed: Dec. 3, 2015

(86) PCT No.: PCT/DE2015/000574
§ 371 (c)(1),
(2) Date: Jun. 8, 2017

(87) PCT Pub. No.: WO2016/091245
PCT Pub. Date: Jun. 16, 2016

(65) Prior Publication Data

US 2017/0335844 A1 Nov. 23, 2017

(30) Foreign Application Priority Data

Dec. 9, 2014 (DE) ..... 10 2014 018 179

(51) Int. Cl.
*F04C 2/08* (2006.01)
*F04C 2/10* (2006.01)
(Continued)

(52) U.S. Cl.
CPC ..... *F04C 2/084* (2013.01); *F01C 21/02* (2013.01); *F01C 21/106* (2013.01); *F04C 2/102* (2013.01);
(Continued)

(58) Field of Classification Search
CPC ..... F04C 2/084; F04C 2/102; F04C 15/0088; F04C 2/088; F01C 21/106
(Continued)

(56) References Cited

U.S. PATENT DOCUMENTS

2004/0234393 A1 11/2004 Kim
2007/0292295 A1* 12/2007 White ..... F03C 2/08 418/61.3

(Continued)

FOREIGN PATENT DOCUMENTS

DE 26 06 172 C2 12/1983
DE 10 2006 047 312 A1 4/2008

(Continued)

OTHER PUBLICATIONS

Letter to WIPO from the German Patent Attorney dated May 17, 2016 regarding PCT/DE2015/000574, along with an English translation of the relevant parts.

(Continued)

*Primary Examiner* — Deming Wan
(74) *Attorney, Agent, or Firm* — Collard & Roe, P.C.

(57) ABSTRACT

A gerotor pump includes a rotor wherein only on the face wall of the rotor that lies adjacent to a pressure kidney and a suction kidney, a lubrication surface inclined in the direction of rotation of the rotor, relative to the surface plane of the face wall of the rotor, is disposed on each tooth, in each instance, over its tooth height, either starting directly in the center tooth plane or starting "offset" ahead of the center tooth plane in the direction of rotation of the rotor, which (Continued)

Figure 1:
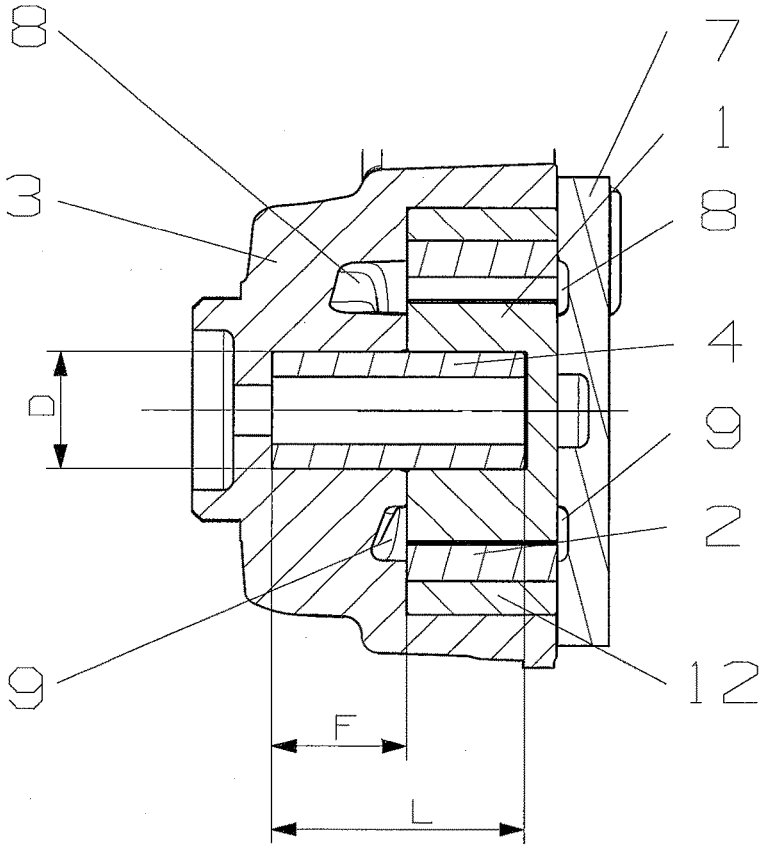

surface is formed from a level surface or multiple, always level partial surfaces that follow one another, which enclose an angle of inclination relative to the surface plane of the face wall of the rotor, in each instance, which angle lies in the range from 0.2° to 7°, in each instance.

6 Claims, 6 Drawing Sheets

(51) Int. Cl.
*F01C 21/10* (2006.01)
*F04C 15/00* (2006.01)
*F01C 21/02* (2006.01)

(52) U.S. Cl.
CPC ..... *F04C 15/0088* (2013.01); *F04C 2240/20* (2013.01); *F04C 2240/56* (2013.01); *F05C 2203/08* (2013.01)

(58) Field of Classification Search
USPC ..... 418/166, 61.3, 171
See application file for complete search history.

(56) References Cited

U.S. PATENT DOCUMENTS

2010/0028186 A1 2/2010 Sevelsted et al.
2012/0082579 A1* 4/2012 Mori ..... F04C 2/084 418/166

FOREIGN PATENT DOCUMENTS

DE 10 2012 205 406 A1 10/2013
GB 1 564 854 A 4/1980
WO 2014/147440 A1 9/2014

OTHER PUBLICATIONS

English translation of the Written Opinion of the International Searching Authority in PCT/DE2015/000574, dated Mar. 24, 2016.
International Search Report of PCT/DE2015/000574, dated Mar. 24, 2016.

* cited by examiner

GEROTOR PUMP HAVING AN INNER GEAR, A ROTOR, AND AN OUTER GEAR, WITH INCLINED LUBRICATION SURFACE ON TEETH OF FACE WALL OF ROTOR ADJACENT TO PRESSURE KIDNEY AND SUCTION KIDNEY

CROSS REFERENCE TO RELATED APPLICATIONS

This application is the National Stage of PCT/DE2015/000574 filed on Dec. 3, 2015, which claims priority under 35 U.S.C. § 119 of German Application No. 10 2014 018 179.0 filed on Dec. 9, 2014, the disclosure of which is incorporated by reference. The international application under PCT article 21(2) was not published in English.

The invention relates to a gerotor pump for rotors having tooth tip diameters of from approximately 20 to approximately 40 mm, which operate at conveying pressures in the range between 3 to 20 bar, and are used for conveying barely lubricating media such as, for example, an oil pump in the automotive sector for conveying low-viscosity motor oils.

In the state of the art, there are a plurality of applications regarding the principle and the method of operation of gerotor pumps having an inner gear having outer teeth and a gear ring having inner teeth, the outer gear, which is guided in a circular recess of a housing ring, in such a manner that the two gear wheels stand in meshing engagement and rotate about their own axes, which are, however, offset from one another, wherein the rotors that stand in engagement form pressure spaces (pressure chambers) circumferentially with one another, which spaces/chambers change cyclically with regard to their size and their position.

Face walls are disposed as covers and/or housings on both sides of these meshing gear wheels, wherein an arc-shaped pressure groove is disposed on one side and an arc-shaped suction groove is disposed on the other side in at least one of the face walls/covers, on both sides of the eccentricity plane, which contains the axes and appears as a center line in section.

These gear wheel pumps, which operate according to the gerotor principle, require highly precise adherence to eccentricity, and the most cost-advantageous production when used for the automotive sector, with great reliability and a long useful lifetime.

A gerotor pump is previously described in DE 10 2012 205 406 A1, in which a reduction in the pressure pulsation is supposed to be brought about by means of curved intervention lines that deviate from a straight line, and by an edge region of the face wall of the gear wheel that is chamfered along the entire toothed profile, which reduction results in a reduction of noise development during operation of the aforementioned gerotor pump.

In this regard, worsening of the sealing behavior between the edges of the tooth flanks during operation of this displacement machine is accepted in this solution, because of the gap connection that results from this solution.

A solution presented in DE 10 2006 047 312 A1 in connection with a gerotor pump also serves for reducing the pressure peaks during operation of this hydraulic machine.

In the solution according to DE 10 2006 047 312 A1, rectangular recesses are disposed on both sides of the gear wheel, on both sides of the peak point of the tooth tip, which recesses bring about a short-circuit with the adjacent pressure chamber at the points in time at which the pressure chamber has a minimal or maximal volume, thereby making return flow of the fluid to the adjacent chamber and thereby pressure equalization possible. As a result of the reduction in positive and negative pressure peaks brought about in this way, the operating behavior of the hydraulic machine is supposed to be structured to be low-wear here.

In DE 26 06 172 C2, a further construction form of a gerotor pump having small radial dimensions is previously described, in which the leakage losses are supposed to be kept small by means of affixation on one side of a sealing ring that lies against a continuous face wall of the gerotor pump and is positioned in a ring groove on the adjacent gear wheel face side. This affixation on one side of a sealing element on the inner rotor, however, has the result that the gear wheel is pressed against the opposite face wall, which is provided with the opening, with significant force. In order to now reduce the very high friction forces that result from the great normal force, two pressure compensation surfaces in the form of two depressions, which are separated from one another by means of a radial crosspiece, which surfaces are connected with the adjacent displacer chambers, are disposed on the face side of the gear wheel that lies opposite the sealing element, at the top of each tooth tip, over part of the tooth tip height, symmetrical to the center axis of the tooth. The great normal force that is brought about by the seal on one side, bringing about a friction force, i.e. the axial sealing force is supposed to be lowered or compensated to such an extent, by means of these pressure compensation surfaces, that although a press-down force of the gear wheel against the face wall provided with the opening is still present, reducing the leakage gap, this press-down force is reduced to such an extent, however, that "excessive" friction no longer occurs. In this regard, the radial crosspiece disposed between two displacer chambers on the face side of the tooth tip brings about the result that the displacer chambers disposed on the tooth tip, adjacent to one another, are not short-circuited.

However, in this solution of a gerotor pump having a small radial diameter, a tilting force is brought about by the pump pressure applied to the gear wheel/inner rotor, which brings about partial contact of the inner rotor, over approximately 180° of the angle of rotation, with the opposite face wall of the gerotor pump, and results in wear that cannot be ignored.

This wear problem, as well as the friction forces that necessarily occur in such designs, occur to a greater extent when conveying media having low viscosity, and furthermore result in great drive torques.

To reduce fuel consumption, in recent years motor oils having low viscosity have increasingly been used in the automotive sector.

When passing through (conveying) media that barely lubricate, there is therefore a need, also in the case of oil pumps, to use very hard and, at the same time, corrosion-resistant materials, for example ceramic or hard metal.

Use of these materials is practical in the case of all functional components of the gerotor pump that are subject to tribological stress, in order to thereby avoid the constant wear that occurs when using soft materials.

From a production-technology point of view, particularly for cost reasons, however, production of the pump housing from ceramic or hard metal is very cost-intensive.

The use of sleeve-guided rotors, using low-wear bearing sleeves composed of ceramic or hard metal, has been usual for decades. Likewise, fixation of these sleeves in pump housings composed of castings/light metal, using adhesive or the like, has been known for many years.

In connection with the use of sleeve-guided rotors, particularly in smaller pump systems, the rotors of which have tooth tip diameters of approximately 20 to approximately 40 mm, and which operate at conveying pressures in the range from 3 to 20 bar, an over-proportional increase in the drive moment with a simultaneous loss in the degree of effectiveness becomes noticeable, particularly at low speeds of rotation in the range of 500 to 1,000 rpm and a high working pressure.

The cause of this is that at an overly low slide speed in connection with the use of low-viscosity conveying media, a dynamically supportive lubricant film can no longer build up, so that the system makes a transition to the state of mixed friction.

Even when using low-wear bearing sleeves composed of ceramic or hard metal, in the case of sleeve-guided rotors, particularly in connection with the use of pump housings composed of castings/light metal, measurable wear phenomena occur in the region on both sides of the suction groove, on the housing and/or on the cover, which phenomena are attributable to contact of the rotor with the housing and/or cover at increasing operating pressures and a decreasing viscosity of the medium to be conveyed, and result in leakage losses between the pressure side and the suction side of the gerotor pump, which losses increase with the period of use.

This results in an over-proportional increase in drive moment with a simultaneous loss in the degree of effectiveness of the pump, thereby severely impairing not only the reliability but also the useful lifetime of the gerotor pump described above.

The invention is therefore based on the task of developing a gerotor pump having a sleeve-guided rotor, which pump eliminates the aforementioned disadvantages of the state of the art, and which, when using low-viscosity conveying media, such as "thin, light oil," in connection with use in smaller pump systems, the rotors of which have tooth tip diameters of approximately 20 to approximately 40 mm, and the conveying pressures of which lie in the range from 3 to 20 bar, and which clearly reduce an over-proportional increase of the drive moment with a simultaneous loss in degree of effectiveness, at low speeds of rotation in the range from 500 to 1,000 rpm and high conveying pressures, so that the gerotor pump according to the invention always guarantees a high degree of pump effectiveness at great reliability and a long useful lifetime.

According to the invention, this task is accomplished by means of a gear wheel pump in accordance with the characteristics of the independent claim of the invention.

Advantageous embodiments, details, and characteristics of the invention are evident from the dependent claims and from the drawings that represent the solution according to the invention.

These representations show, in

Figure 2:
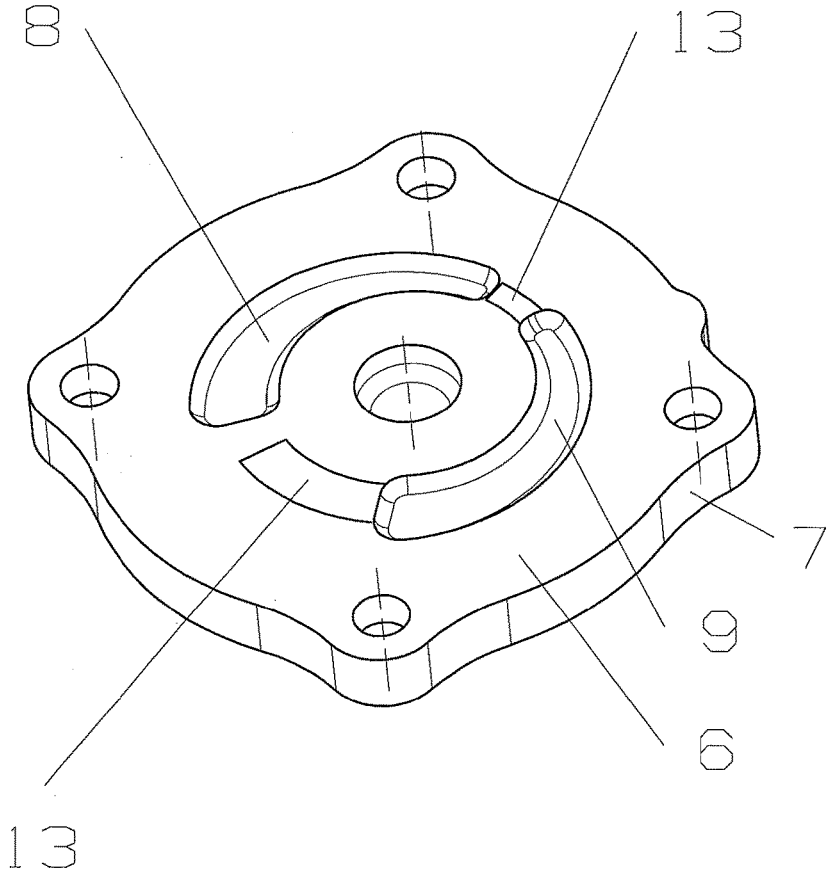
Figure 3:
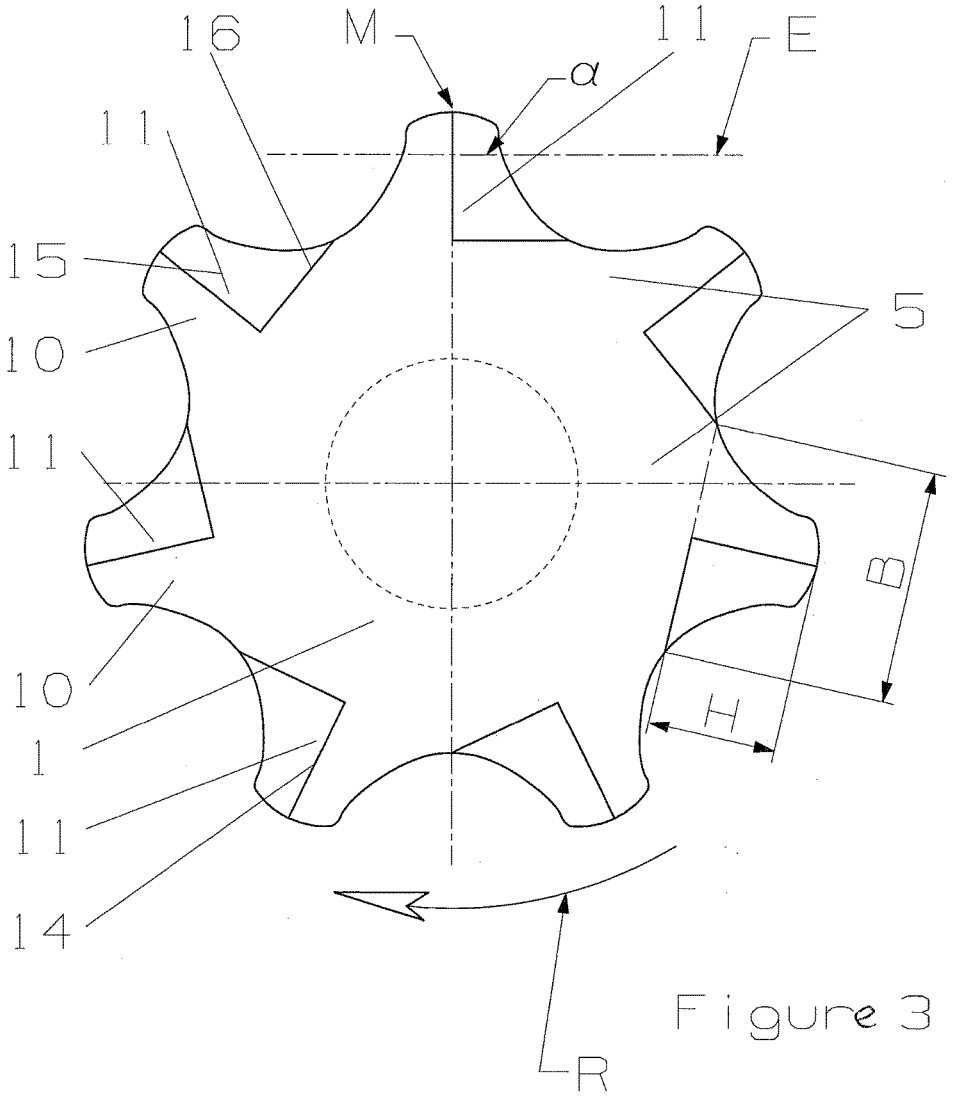
Figure 4:
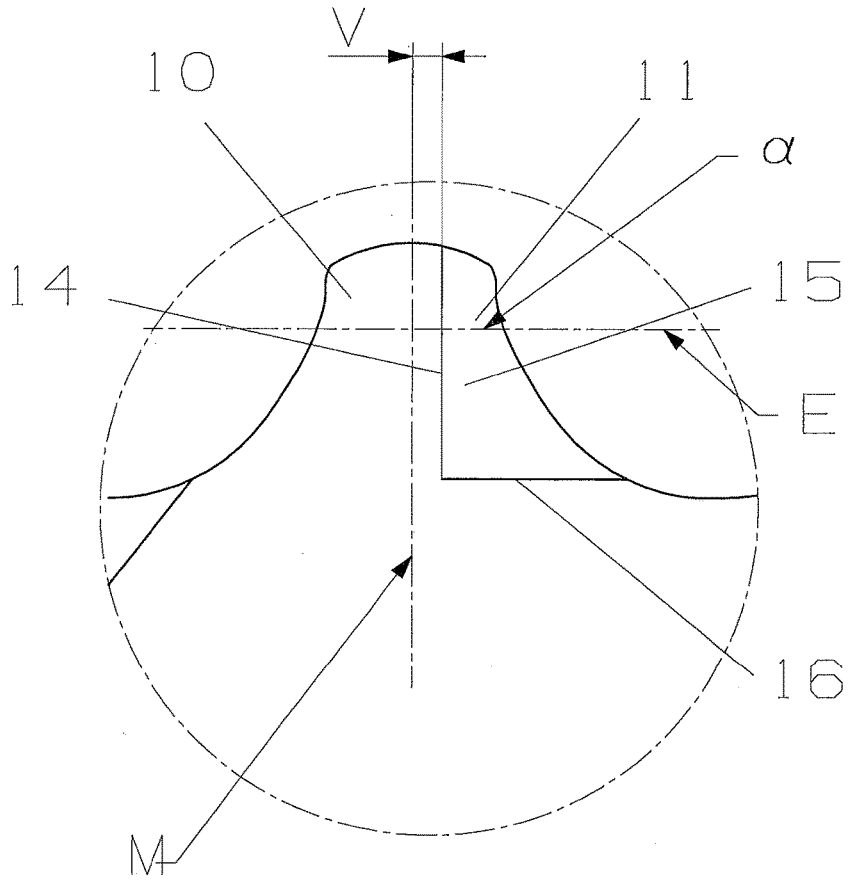
Figure 5:
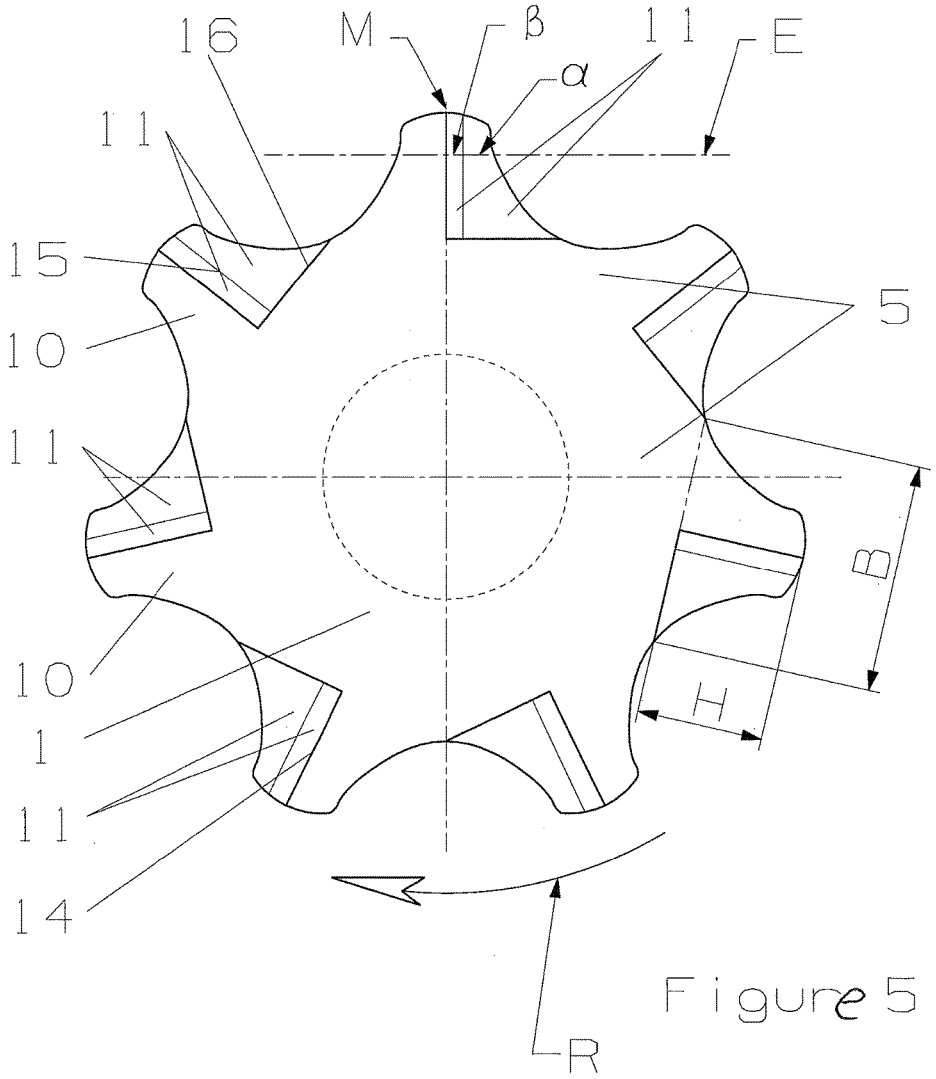
Figure 6:
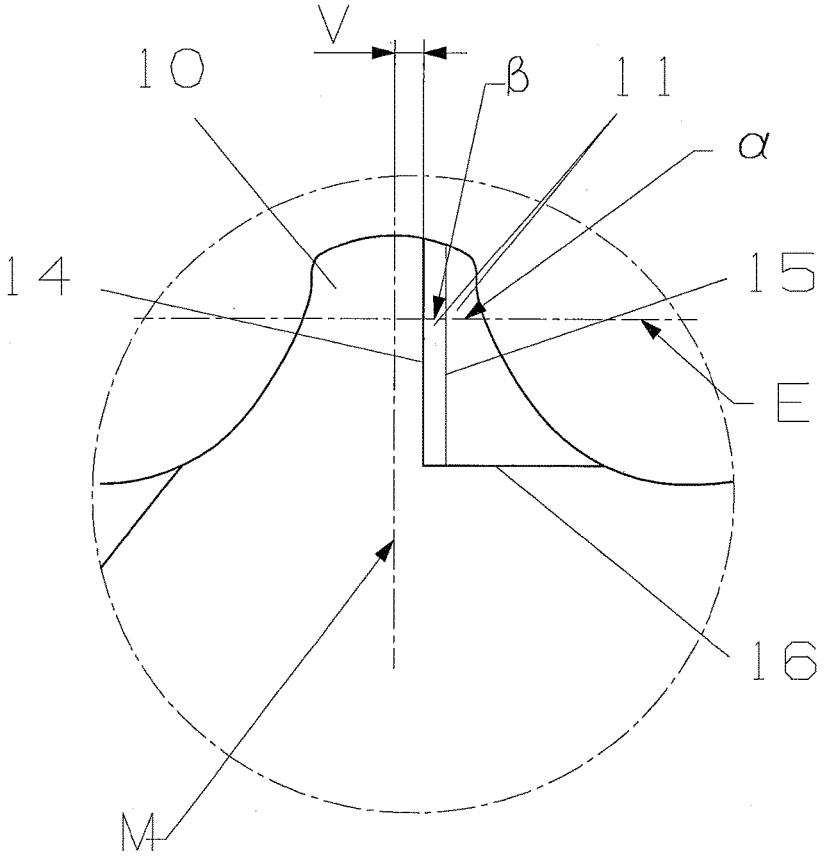

FIG. 1: a gerotor pump, in section, in a side view;

FIG. 2: the spatial view of the side wall 6 of the cover 7, of a gerotor pump according to the state of the art, structured analogous to FIG. 1, and used here in accordance with the task, having the wear tracks 13 usual in the state of the art;

FIG. 3: the top view of a rotor 1 structured according to the invention, having a level lubrication surface 11 inclined at an angle of inclination α;

FIG. 4: the top view of the tooth wall of a tooth 10, shown as a detail of a further possible embodiment according to the invention, having a level lubrication surface 11 that begins "offset" in the direction of rotation R of the rotor 1, ahead of the tooth center plane M, and is inclined at an angle of inclination α, of a rotor equipped with these tooth walls, structured analogous to FIG. 3;

FIG. 5: the top view of a rotor 1 structured according to the invention, having an inclined lubrication surface 11 stepped at two angles of inclination α and β;

FIG. 6: the top view of the tooth wall, shown as a detail, of a tooth 10 of a further possible embodiment according to the invention, having a level lubrication surface 11 that begins "offset" in the direction of rotation R of the rotor 1, ahead of the tooth center plane M, and is inclined at two angles of inclination α and β, of a rotor equipped with these tooth walls, structured analogous to FIG. 5.

The gerotor pump according to the invention, shown in FIG. 1, having an inner gear with outer teeth, as shown in FIGS. 3 to 6, the rotor 1, and an outer gear having inner teeth, the gear ring 2, which is guided in a circular working chamber of a pump housing 3, in such a manner that the two gears stand in meshing engagement and rotate about their own axes, which are, however, offset relative to one another, wherein the rotor 1 is mounted on a bearing sleeve 4 on one side, and side walls 6 are disposed on both sides of the face walls 5 of the gear wheels that mesh with one another, in each instance, which walls are either integrated into the pump housing 3 or can be disposed on the pump housing 3 as covers 7, wherein an arc-shaped pressure kidney 8 is disposed in at least one of these side walls 6, on both sides of the eccentricity plane that contains the axes of rotor 1 and gear ring 2, which axes are offset relative to one another, and an arc-shaped suction kidney 9 is disposed on the opposite side, in each instance, is characterized in that on the face wall 5 of the rotor 1 that lies adjacent to the pressure kidney 8 and the suction kidney 9, a lubrication surface 11 inclined in the direction of rotation R of the rotor 1, relative to the surface plane of the face wall 5 of the rotor 1, is disposed on each tooth 10, in each instance, over its tooth height H, either starting in the center tooth plane M or starting "offset" ahead of the center tooth plane M in the direction of rotation R of the rotor 1, which surface is formed from a level surface or multiple level partial surfaces that follow one another, which enclose an angle of inclination α, β, γ, . . . relative to the surface plane of the face wall 5 of the rotor 1, in each instance, which angle lies in the range from 0.2° to 7°, in each instance.

By means of these lubrication surfaces 11, disposed on/in the face wall/face walls 5 of the rotor 1, which lie adjacent to the pressure kidney 8 and the suction kidney 9, on each tooth 10 of the rotor 1, according to the invention, inclined in the direction of rotation R of the rotor 1, the wear behavior of the gerotor pumps used in the state of the art, according to the task, as shown in FIG. 2, in a spatial representation of the side wall 6 of the cover 7, can be clearly reduced.

The wear tracks 13 shown in FIG. 2, which are usual in the current state of the art, are attributable to the fact in the case of poorly lubricating conveyed media, such as low-viscosity conveyed media/oils, a supporting lubricant film can no longer build up between the face wall 5 of the rotor 1 and the adjacent side wall 6 of the pump housing 3 or of the cover 7, provided with the pressure kidney 8 and the suction kidney 9, because the slide speeds are too low, so that the system makes a transition into the state of mixed friction, wherein because of the bearing play, the rotor 1 runs up against the adjacent side wall 6 of the gerotor pump and increasingly "tilts" due to stress on one side brought about by the pressure difference between the pressure in the pressure kidney 8 and the pressure in the suction kidney 9, and, in this regard, continues to "mill itself" deeper and deeper into the adjacent side wall/side walls 6 up to a maximally possible tilt angle of the rotor 1, which results from the possible guide play "on" (i.e. together with) the guide sleeve.

This wear cannot be completely prevented even with very cost-intensive slide pairings, because all traditional slide bearing pairings fail in this mixed friction range, thereby causing constantly advancing wear to occur in long-term operation, even in the case of very expensive slide pairings, even in combination with cost-intensive coatings or the like, which wear cannot be mastered and results in a continuous loss of the degree of effectiveness of the pump, as the result of constantly increasing wear-related leakage losses.

The lubrication surface 11 according to the invention, disposed on each tooth 10 of the rotor 1 on/in the face wall 5 of the rotor 1 adjacent to the pressure kidney 8 and the suction kidney 9, inclined in the direction of rotation R of the rotor 1, brings about the result that even under disadvantageous general conditions, such a great working pressures, when conveying poorly lubricating conveyed media, with simultaneously low slide speeds of the slide partners, and cost-advantageous slide pairings, a hydrodynamically supporting lubricant film builds up between the face wall 5 of the rotor 1 and the side wall 6 of the gerotor pump that lies adjacent to it.

It is characteristic, in this connection, that the lubrication surface 11, which is inclined in the direction of rotation R of the rotor 1 relative to the surface plane of the face wall 5, is configured to be level, as shown in FIGS. 3 and 4, and consists of a level surface that encloses an angle of inclination $\alpha$ relative to the surface plane of the face wall 5 of the rotor 1, which angle lies in the range from 0.2° to 7°. Very good results were achieved, for example, with a level lubrication surface as shown in FIG. 3, which is inclined at an angle of inclination $\alpha$ of 0.5° relative to the surface plane of the face wall 5 of the rotor 1.

In a further exemplary embodiment, as shown in FIG. 5, the lubrication surface 11 disposed on the face wall 5 of the rotor 1 on each tooth 10 is formed by two level partial surfaces that follow one another, in each instance, which surfaces enclose an angle of inclination $\alpha$ or $\beta$ relative to the surface plane of the face wall 5 of the rotor 1, in each instance, wherein $\alpha$ is smaller than $\beta$, and the partial surface of the lubrication surface 11 that is inclined at the greater angle of inclination $\beta$ makes a transition into the surface plane of the face wall 5 of the rotor 1 at the surface run-out 14.

In this exemplary embodiment, shown in FIG. 5, the angle of inclination $\alpha$ amounts to 0.2°, and the angle of inclination $\beta$ amounts to 5°. The two partial surfaces of the lubrication surface 11 together form a surface separator 15 and, in this regard, lie against one another at an obtuse angle, wherein the partial surface of the lubrication surface 11 that is inclined at the "second" angle of inclination $\beta$ makes a transition into the surface plane of the face wall 5 of the rotor 1 at the surface run-out 14. The two partial surfaces of the lubrication surface 11 make a transition into the surface plane of the face wall 5 of the rotor 1 in the direction of the rotor center, along a steep surface edge 16. In the present exemplary embodiment, the rotor 1 consists of a material SintD39, the gear ring 2 also consists of SintD39, the bearing ring 12 consists of St38, and the pump housing 3 consists of the material AlSi9Cu3.

The level partial surfaces of the lubrication surface 11 shown in the exemplary embodiment according to FIG. 5, disposed on each tooth 10, running in the inclination plane E, tangential to the direction of rotation and parallel to the center axis of the rotor 1, at the aforementioned angles of inclination $\alpha$ and $\beta$, can be produced in simple and cost-advantageous manner, in terms of production technology, and guarantee an optimal solution for the task according to the invention under the aforementioned conditions of use.

It is also in accordance with the invention if, as shown in FIGS. 4 and 6, the lubrication surfaces 11 disposed in the face wall 5 of the rotor 1, on each tooth 10, over the entire tooth height H, are disposed "offset" ahead of the tooth center plane M in the direction of rotation R of the rotor 1, in such a manner that they start parallel to the tooth center plane M and offset by the offset V of maximally 20% of the tooth root width B.

In this way, as in the case of an axial slide bearing, a local pressure buildup is brought about, which once again measurably reduces the friction force between the rotor 1 and the cover 7.

It is also essential to the invention that the bearing sleeve 4 consists of a ceramic material that has a low roughness depth on its bearing surface.

In the present exemplary embodiments, the roughness values of the bearing surface of the bearing sleeve 4 lie around Rz=1, wherein the bearing sleeve 4 itself consists of the material $Al_2O_3$.

The roughness of the related bearing bore of the rotor 1 lies at Rk<=3 in the present exemplary embodiment.

In all the embodiments, even after 2,100 h long-term testing under maximal stress, no wear could be detected using measurement technology, neither on the bearing sleeve 4 nor on the rotor 1.

Furthermore, surprisingly, a microdynamic effect that could not be explained even now occurred on the "bearing surface" of the rotor 1, on the cover 7, in the form of "self-polishing," which effect cannot be explained at the present time using slide bearing theory, because the definitively present mixed friction would have to produce progressive wear tracks because of the direct body contact, according to current theory. However, this wear could not be detected even according to long-term tests under maximal stress.

It is furthermore characteristic that the guide length F of the bearing sleeve 4 amounts to 2 times to 2.3 times the bearing diameter D.

In this way, deformation of the sleeve bore and resulting "tilting" of the rotor 1 is effectively reduced, even in the case of pump housings 3 composed of light metal (for example Al alloys).

It is advantageous, independent of sleeve fixation, particularly in the case of cast housings, that the region surrounding the sleeve guide is configured with great rigidity, in terms of design, in order to effectively prevent possible deformation of the sleeve bore caused by the "work load" of the rotor 1 that acts on the bearing sleeve 4.

It is also characteristic that the guide length F of the bearing sleeve 4 amounts to about 53% to 60% of the total length L of the bearing sleeve 4.

In connection with the aforementioned configuration of the area surrounding the sleeve bore, the guide length F of the bearing sleeve 4, according to the invention, guarantees not only positioning in a secure position, whether by means of adhesion or by means of press fit, of the bearing sleeve 4 in the pump housing 3, in connection with the use of a bearing sleeve 4 composed of a material having a high modulus of elasticity (for example ceramic/modulus of elasticity approximately 380 to 400 GPa), with simultaneously bending-resistant configuration of the bearing sleeve (in other words counteracting bending of the bearing sleeve 4 at great radial stress), but also reliable positioning of the rotor 1 in the pump housing 3.

It is also advantageous if the pump housing 3 is produced from an aluminum casting. This allows not only cost-advantageous production that is simple in terms of production technology, but at the same time allows great reliability and a long useful lifetime.

Thereby it has been made possible, by means of the solution according to the invention, to develop a gerotor pump having sleeve-guided rotors, which clearly reduce an over-proportional increase in the drive moment, with a simultaneous loss of the degree of effectiveness, even when using low-viscosity conveyed media, such as "thin, light oil," in connection with use in smaller pump systems, the rotors of which have tooth tip diameters from approximately 20 to approximately 40 mm, and the conveying pressures of which lie in the range from 3 to 20 bar, and even at low speeds of rotation in the range from 500 to 1,000 rpm and a high conveying pressure, so that the gerotor pump according to the invention always guarantees a high degree of pump effectiveness, with great reliability and a long useful lifetime.

REFERENCE SYMBOL LIST

1 rotor
2 gear ring
3 pump housing
4 bearing sleeve
5 face wall
6 side wall
7 cover
8 pressure kidney
9 suction kidney
10 tooth
11 lubrication surface
12 bearing ring
13 wear tracks
14 surface run-out
15 surface separator
16 surface edge
H tooth height
B tooth root width
M tooth center plane
R direction of rotation
F guide length
L total length
D bearing diameter
E inclination plane
V offset
α, β, γ angles of inclination

The invention claimed is:

1. Gerotor pump having an inner gear having outer teeth, a rotor (1), and an outer gear having inner teeth, a gear ring (2), which is guided in a circular working chamber of a pump housing (3), in such a manner that the inner fear and the outer gear stand in meshing engagement and rotate about their own axes, which are, however, offset relative to one another, wherein the rotor (1) is mounted on a bearing sleeve (4) on one side, and side walls (6) are disposed on both sides of face walls (5) of the inner gear and the outer gear that mesh with one another, in each instance, wherein the side walls are either integrated into the pump housing (3) or can be disposed on the pump housing (3) as covers (7), wherein an arc-shaped pressure kidney (8) is disposed in the at least one of these side walls (6), on both sides of an eccentricity plane that contains the axes of the inner gear and the outer gear, wherein the axes of the inner gear and the outer gear are offset relative to one another, and an arc-shaped suction kidney (9) is disposed on an opposite side, in each instance, wherein only on the face wall (5) of the rotor (1) that lies adjacent to the arc-shaped pressure kidney (8) and the arc-shaped suction kidney (9), a lubrication surface (11) inclined in a direction of rotation (R) of the rotor (1), relative to a surface plane of the face wall (5) of the rotor (1), is disposed on each of the tooth (10) of the rotor, in each instance, over its tooth height (H), either starting directly in a center tooth plane (M) or starting "offset" ahead of the center tooth plane (M) in the direction of rotation (R) of the rotor (1), wherein the lubrication surface is formed from a level surface or multiple, always level partial surfaces that follow one another, which enclose an angle of inclination (α, β, γ, . . . ) relative to the surface plane of the face wall (5) of the rotor (1), in each instance, wherein the angle of inclination lies in the range from 0.20 to 70, in each instance.

2. Gerotor pump according to claim 1, wherein the lubrication surface (11) of the face wall (5), inclined in the direction of rotation (R) of the rotor (1), is formed by two level partial surfaces that follow one another, in each instance, wherein the two level partial surfaces enclose the angle of inclination (α) or (β) relative to the surface plane of the face wall (5) of the rotor (1), in each instance, wherein the angle of inclination (a) is smaller than the angle of inclination (β), and one of the two level partial surfaces of the lubrication surface (11) that is inclined at the greater angle of inclination (β) makes a transition into the surface plane of the face wall (5) of the rotor (1) at a surface run-out (14).

3. Gerotor pump according to claim 1, wherein the lubrication surfaces (11) disposed in the face wall (5) of the rotor (1), on each of the tooth of the rotor, over an entire tooth height (H), are disposed "offset" ahead of the tooth center plane (M) in the direction of rotation (R) of the rotor (1), in such a manner that they start parallel to the tooth center plane (M) and offset by the offset (V) of maximally 20% of a tooth root width (B).

4. Gerotor pump according to claim 1, wherein the bearing sleeve (4) comprises a ceramic material that has a low roughness depth on its bearing surface.

5. Gerotor pump according to claim 1, wherein a guide length (F) of the bearing sleeve (4) amounts to 2 times to 2.3 times a bearing diameter (D).

6. Gerotor pump according to claim 1, wherein a guide length (F) of the bearing sleeve (4) amounts to about 53% to 60% of a total length (L) of the bearing sleeve (4).

* * * * *